US006299707B1

(12) United States Patent
McCay et al.

(10) Patent No.: US 6,299,707 B1
(45) Date of Patent: Oct. 9, 2001

(54) METHOD FOR INCREASING THE WEAR RESISTANCE IN AN ALUMINUM CYLINDER BORE

(75) Inventors: Mary Helen McCay; T. Dwayne McCay, both of Monteagle; John A. Hopkins; Narendra B. Dahotre, both of Tullahoma; Frederick A. Schwartz, Woodbury; John Brice Bible, South Pittsburg, all of TN (US)

(73) Assignee: The University of Tennessee Research Corporation, Knoxville, TN (US)

( * ) Notice: Subject to any disclaimer, the term of this patent is extended or adjusted under 35 U.S.C. 154(b) by 0 days.

(21) Appl. No.: 09/317,524

(22) Filed: May 24, 1999

(51) Int. Cl.[7] ..... C23C 14/22

(52) U.S. Cl. ..... 148/512; 148/525; 219/121.82; 219/121.85; 427/556; 427/597

(58) Field of Search ..... 148/512, 525, 148/565; 427/556, 597; 219/121.82, 121.85

(56) References Cited

U.S. PATENT DOCUMENTS

| | | |
|---|---|---|
| 3,705,758 | 12/1972 | Haskal . |
| 3,848,104 | 11/1974 | Lockle . |
| 3,986,767 | 10/1976 | Rexer et al. . |
| 4,015,100 | 3/1977 | Gnanamuthu et al. . |

(List continued on next page.)

FOREIGN PATENT DOCUMENTS

| | | |
|---|---|---|
| 4126351 | 2/1993 | (DE) . |
| 876870A1 | 4/1998 | (EP) . |
| 279692 | 11/1988 | (JP) . |
| 401083676A | 3/1989 | (JP) . |
| 381082 | 4/1991 | (JP) . |
| 3115587A | 5/1991 | (JP) . |
| 403115531A | 5/1991 | (JP) . |
| 5285686 | 11/1993 | (JP) . |
| 1557193 | 4/1990 | (SU) . |
| 1743770 | 6/1992 | (SU) . |
| WO 95/21720 | 8/1995 | (WO) . |
| WO 97/47397 | 12/1997 | (WO) . |

OTHER PUBLICATIONS

Ayers, et al.; "A Laser Processing Technique for Improving the Wear Resistance of Metals," *Journal of Metals,* Aug. 1981, 19–23.

Belvaux, et al.; "A Method for Obtaining a Uniform Non–Gaussian Laser Illumination," *Optics Communications,* vol. 15, No. 2, Oct. 1975, 193–195.

Bett, et al.; "Binary phase zone–plate arrays for laser–beam spatial–intensity distribution conversion," *Applied Optics,* vol. 34, No. 20, Jul. 10, 1995, 4025–4036.

Bewsher, et al.; "Design of single–element laser–beam shape projectors," *Applied Optics,* vol. 35, No. 10, Apr. 1, 1996, 1654–1658.

Breinan, et al.; "Processing material with lasers," *Physics Today,* Nov. 1976, 44–50.

Bruno, et al.; "Laserbeam Shaping for Maximum Uniformity and Maximum Loss, A Novel Mirror Arrangement Folds the Lobes of a Multimode Laserbeam Back onto its Center," *Lasers & Applications,* Apr. 1987, 91–94.

(List continued on next page.)

*Primary Examiner*—George Wyszomierski
(74) *Attorney, Agent, or Firm*—Duane, Morris & Heckscher LLP

(57) ABSTRACT

This invention is directed toward a method for enhancing the wear resistance of an aluminum cylinder bore comprising laser alloying of the cylinder bore with selected precursors. The present invention is particularly well suited for enhancing the wear resistance caused by corrosion in an aluminum block engine comprising aluminum cylinder bores.

18 Claims, 4 Drawing Sheets

U.S. PATENT DOCUMENTS

| | | | | |
|---|---|---|---|---|
| 4,017,708 | | 4/1977 | Engel et al. . | |
| 4,157,923 | | 6/1979 | Yen et al. . | |
| 4,212,900 | | 7/1980 | Serlin . | |
| 4,322,601 | | 3/1982 | Serlin . | |
| 4,434,189 | | 2/1984 | Zaplatynsky . | |
| 4,475,027 | | 10/1984 | Pressley . | |
| 4,480,169 | | 10/1984 | Macken . | |
| 4,495,255 | | 1/1985 | Draper et al. . | |
| 4,535,218 | | 8/1985 | Krause et al. . | |
| 4,617,070 | | 10/1986 | Amende et al. . | |
| 4,638,163 | | 1/1987 | Braunlich et al. . | |
| 4,644,127 | | 2/1987 | La Rocca . | |
| 4,695,329 | * | 9/1987 | Hayashi et al. | 148/565 |
| 4,720,312 | | 1/1988 | Fukuizumi et al. . | |
| 4,724,299 | | 2/1988 | Hammeke . | |
| 4,746,540 | | 5/1988 | Kawasaki et al. . | |
| 4,750,947 | | 6/1988 | Yoshiwara et al. . | |
| 4,801,352 | | 1/1989 | Piwczyk . | |
| 4,839,518 | | 6/1989 | Braunlich et al. . | |
| 4,847,112 | | 7/1989 | Halleux . | |
| 4,898,650 | | 2/1990 | Wu et al. . | |
| 4,904,498 | | 2/1990 | Wu . | |
| 4,964,967 | | 10/1990 | Hashimoto et al. . | |
| 4,981,716 | | 1/1991 | Sundstrom . | |
| 4,998,005 | | 3/1991 | Rathi et al. . | |
| 5,059,013 | | 10/1991 | Jain . | |
| 5,095,386 | | 3/1992 | Scheibengraber . | |
| 5,124,993 | | 6/1992 | Braunlich et al. . | |
| 5,130,172 | | 7/1992 | Hicks et al. . | |
| 5,147,999 | | 9/1992 | Dekumbis et al. . | |
| 5,196,672 | | 3/1993 | Matsuyama et al. . | |
| 5,208,431 | | 5/1993 | Uchiyama et al. . | |
| 5,230,755 | | 7/1993 | Pierantoni et al. . | |
| 5,247,155 | | 9/1993 | Steen et al. . | |
| 5,257,274 | | 10/1993 | Barrett et al. . | |
| 5,265,114 | | 11/1993 | Sun et al. . | |
| 5,267,013 | | 11/1993 | Spence . | |
| 5,290,368 | | 3/1994 | Gavigan et al. . | |
| 5,308,431 | | 5/1994 | Maher et al. . | |
| 5,314,003 | | 5/1994 | Mackay . | |
| 5,319,195 | | 6/1994 | Jones et al. . | |
| 5,322,436 | | 6/1994 | Horng et al. . | |
| 5,331,466 | | 7/1994 | Van Saarloos . | |
| 5,352,538 | | 10/1994 | Takeda et al. . | |
| 5,387,292 | | 2/1995 | Morishige et al. . | |
| 5,406,042 | | 4/1995 | Engelfriet et al. . | |
| 5,409,741 | | 4/1995 | Laude . | |
| 5,411,770 | | 5/1995 | Tsai et al. . | |
| 5,430,270 | | 7/1995 | Findlan et al. . | |
| 5,446,258 | | 8/1995 | Mordike . | |
| 5,449,536 | | 9/1995 | Funkhouser et al. . | |
| 5,466,906 | | 11/1995 | McCune, Jr. et al. . | |
| 5,484,980 | | 1/1996 | Pratt et al. . | |
| 5,486,677 | | 1/1996 | Maischner et al. . | |
| 5,491,317 | | 2/1996 | Pirl . | |
| 5,514,849 | | 5/1996 | Findlan et al. . | |
| 5,530,221 | | 6/1996 | Benda et al. . | |
| 5,546,214 | | 8/1996 | Black et al. . | |
| 5,563,095 | | 10/1996 | Frey . | |
| 5,614,114 | | 3/1997 | Owen . | |
| 5,643,641 | | 7/1997 | Turchan et al. . | |
| 5,659,479 | | 8/1997 | Duley et al. . | |
| 5,719,376 | * | 2/1998 | Snyder et al. | 148/565 |
| 5,874,011 | | 2/1999 | Ehrlich . | |
| 5,985,056 | * | 9/1999 | McCam et al. | 148/525 |

OTHER PUBLICATIONS

Chen, et al.; "The Use of a Kaleidoscope to Obtain Uniform Flux Over a Large Area in a Solar or Arc Imaging Furnace," *Applied Optics,* vol. 2, No. 3, Mar. 1963, 265–571.

Christodoulou, et al.; "Laser surface melting of some alloy steels," *Metals Technology,* Jun. 1983, vol. 10, 215–222.

Cullis, et al.; "A device for laser beam diffusion and homogenisation," J. Phys.E:Sci. Instrum., vol. 12, 1979, 668–689.

Dahotre, et al., "Development of microstructure in laser surface alloying of steel with chromium," *Journal of Materials Science,* vol. 25, 1990, 445–454.

Dahotre, et al., "Laser Surface Melting and Alloying of Steel with Chromium," *Laser Material Processing III,* 1989, 3–19.

Fernelius, et al.; "Design and Testing of a Refractive Laser Beam Homogenizer," *Airforce Writing Aeronautical Laboratories Report,* (AFWAL–TR–84–4042), Sep. 1984, 46 pages.

Frieden; "Lossless Conversion of a Plane Laser Wave to a Plane Wave of Uniform Irradiance," *Applied Optics,* vol. 4, No. 11, Nov. 1965, 1400–1403.

Galletti, et al.; "Transverse–mode selection in apertured super–Gaussian resonators: an experimental and numerical investigation for a pulsed $CO_2$ Doppler lidar transmitter," *Applied Optics,* vol. 36, No. 6, Feb. 20, 1997, 1269–1277.

Gori, et al.; "Shape–invariance range of a light beam," *Optics Letters,* vol. 21, No. 16, Aug. 15, 1996, 1205–1207.

Grojean, et al.; "Production of flat top beam profiles for high energy lasers," Rev. Sci. Instrum. 51(3), Mar. 1980, 375–376.

Hella, "Material Processing with High Power Lasers," *Optical Engineering,* vol. 17, No. 3, May–Jun. 1978, 198–201.

Ignatiev, et al.; "Real–time pyrometry in laser machining," *Measurement and Science Technology,* vol. 5, No. 5, 563–573.

"Laser Removing of Lead–Based Paint" Illinois Department of Transportation, Jun. 1992, 26 pages.

Jones, et al.; "Laser–beam analysis pinpoints critical parameters," *Laser Focus World,* Jan. 1993, 123–130.

Khanna, et al.; "The Effect of Stainless Steel Plasma Coating and Laser Treatment on the Oxidation Resistance of Mild Steel," *Corrosion Science,* vol. 33, No. 6, 1992, 949–958.

"New Products" *Laser Focus World,* Aug. 1996, 173.

Lugscheider, et al.; "A Comparison of the Properties of Coatings Produced by Laser Cladding and Conventional Methods," *Surface Modification Technologies V,* The Institute of Materials, 1992, 383–400.

Manna, et al.; "A One–dimensional Heat Transfer Model for Laser Surface Alloying of Chromium on Copper Substrate," *Department of Metallurgical & Materials Engineering,* Indian Institute of Technology, vol. 86, N. 5, May 1995, 362–364.

Mazille, et al.; "Surface Alloying of Mild Steel by Laser Melting of Nickel and Nickel/Chromium Precoatings," *Materials Performance Maintenance,* Aug. 1991, 71–83.

Molian; "Characterization of Fusion Zone Defects in Laser Surface Alloying Applications," *Scripta Metallurgica,* vol. 17, 1983, 1311–1314.

Molian; "Effect of Fusion Zone Shape on the Composition Uniformity of Laser Surface Alloyed Iron," *Scripta Metallurgica,* vol. 16, 1982, 65–68.

Molian; Structure and hardness of laser–processed Fe–0.2%C–5%Cr and Fe–0.2%C–10%Cr alloys; *Journal of Materials Science,* vol. 20, 1985, 2903–2912.
"Line–Focussing Optics for Multiple–Pass Laser Welding," NASA Tech Briefs MFS–29976, date unknown.
"Cylindrical Lenses," *Newport Technical Guide,* date unknown, N–65.
"Fused Silica Cylindrical Lenses," *Newport Technical Guide,,* date unknown, N–68.
Oswald, et al.; "Measurement and modeling of primary beam shape in an ion microprobe mass analyser," IOP Publishing Ltd., 1990, 255–259.
Renaud, et al., "Surface Alloying of Mild Steel by Laser Melting of an Electroless Nickel Deposit Containing Chromium Carbides," *Materials & Manufacturing Processes,* 6(2), 1991, 315–330.
Smurov, et al.; "Peculiarities of pulse laser alloying: Influence of spatial distribution of the beam," J. Appl. Phys. 71(7), Apr. 1, 1992, 3147–3158.
"Spawr Integrator," Spawr Optical Research, Inc., Data Sheet No. 512, Jun. 1986.
Veldkamp, et al.; "Beam profile shaping for laser radars that use detector arrays," *Applied Optics,* vol. 21, No. 2, Jan. 15, 1982, 345–358.
Veldkamp; "Laser Beam Profile Shaping with Binary Diffraction Gratings," *Optics communications,* vol. 38, No. 5,6, Sep. 1, 1981, 381–386.
Veldkamp; "Laser beam profile shpaing with interlaced binary diffraction gratings," *Applied Optics,* vol. 21, No. 17, Sep. 1, 1982, 3209–3212.
Veldkamp; "Technique for generating focal–plane flattop laser–beam profiles," Rev. Sci. Instru., vol. 53, No. 3, Mar. 1982, 294–297.
Walker, et al.; "Laser surface alloying of iron and 1C–1•4Cr steel with carbon," *Metals Technology,* vol. 11, Sep. 1984, 5 pages.
Walker, et al.; "The laser surface–alloying of iron with carbon," Journal of Material Science vol. 20, 1985, 989–995.
Wei, et al.; "Investigation of High–Intensity Beam Characteristics on Welding Cavity Shape and Temperature Distribution," Journal of Heat Transfer, vol. 112, Feb. 1990, 163–169.
Charschan, "Lasers in industry," *Laser Processing Fundamentals,* (Van Nostrand Reinhold Company), Chapter 3, Sec. 3–1, 139–145.
Fernelius, et al; "Calculations Used in the Design of a Refractive Laser Beam Homogenizer," *Airforce Writing Aeronautical Laboratories Report,* (AFWAL–TR–84–4047), Aug. 1984, 18 pages.
Jain, et al.; "Laser Induced Surface Alloy Formation and Diffusion of Antimony in Aluminum," *Nuclear Instruments and Method,* vol. 168, 275–282, 1980.
Molian; "Estimation of cooling rates in laser surface alloying processes," Journal of Materials Science Letters, vol. 4, 1985, 265–267.
"High Power CW Nd:YAG Laser Transformation Hardening," Hobart Laser Products, 2 pages.
ASM Handbook, vol. 6, Welding, Brazing, and Soldering, 1993.

* cited by examiner

METHOD FOR INCREASING THE WEAR RESISTANCE IN AN ALUMINUM CYLINDER BORE

BACKGROUND OF THE INVENTION

1. Field of the Invention

This invention is directed toward a method for enhancing the wear resistance of an aluminum cylinder bore comprising laser alloying of the cylinder bore with selected precursors. The present invention is particularly well suited for enhancing the wear resistance in an aluminum block engine comprising aluminum cylinder bores.

2. Description of the Prior Art

Internal combustion engines comprise cylinder bores which receive reciprocating pistons. These cylinder bores are exposed to harsh environmental conditions, including friction and high temperatures. The harsh environmental conditions result in wear and/or corrosion, thereby reducing the effective life of the aluminum block engine.

SUMMARY OF THE INVENTION

The present invention is directed toward a process or method for producing alloyed aluminum cylinder bores for use in an internal combustion engine. The present invention comprises applying a precursor layer comprising a binder and metallic or ceramic powder to the surface of an aluminum cylinder bore, as shown in Block 10 of FIG. 1. The precursor layer has a thickness in the range of 50–150 microns.

The invention further comprises irradiating the cylinder bore with a laser beam at a sufficient energy level and for a sufficient time to produce an alloyed layer on the surface of the cylinder bore having enhanced wear characteristics, as shown in Block 12 of FIG. 1. During irradiation, the cylinder bore and the laser beam are moved relative to each other.

DESCRIPTION OF THE PREFERRED EMBODIMENTS

Figure 1:
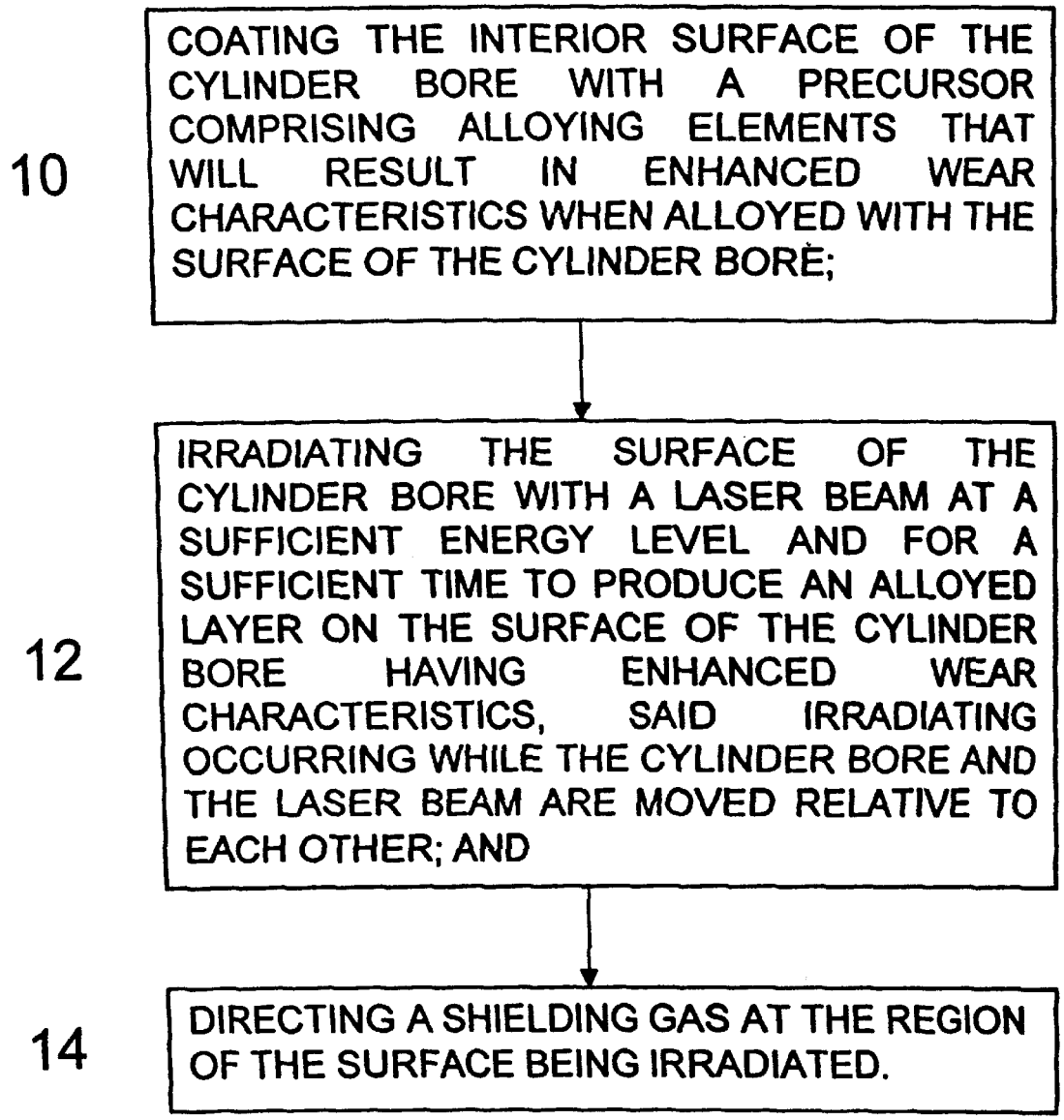
FIG. 1 is a block diagram depicting a first method of the present invention.

The present invention comprises coating the interior surface of the cylinder bore with a precursor layer 21 comprising alloying elements that will result in enhanced wear characteristics when alloyed with the surface of the cylinder bore as shown in Block 10 of FIG. 1. In a preferred embodiment, the precursor comprises iron, tin, copper, zirconium, titanium, zirconium-carbide, titanium-carbide, titanium-diboride, molybdenum, molybdenum-disilicide, molybdenum-disulfide, tungsten-carbide, nickel, aluminum, silicon, or silicon-carbide. In another preferred embodiment, the precursor may comprise encapsulated lubricant particles. In another preferred embodiment, the precursor comprises aluminum, silicon, and copper powder. The precursor layer has a thickness in the range of 50–150 microns.

Figure 2:
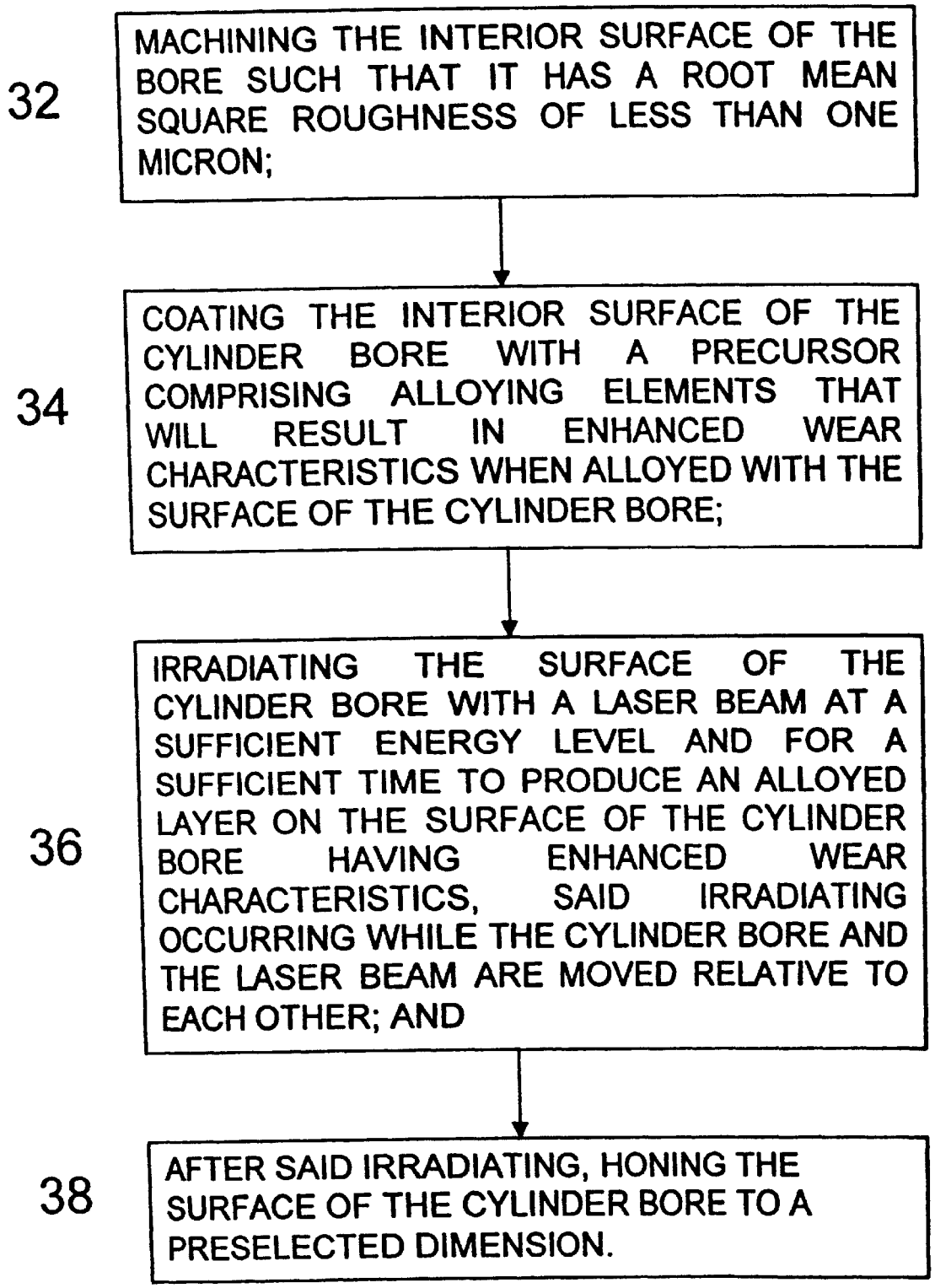
FIG. 2 is a block diagram depicting a second method of the present invention.

In a preferred embodiment, the cylinder bore is machined prior to the application of the binder, as shown in Block 32 of FIG. 2. In a preferred embodiment, this machining is performed with a cylindrical surfacing machine, such as a Mapol machine. In a preferred embodiment, this machining is carried out until the root mean square (rms) roughness of the bore surface is less than one micron.

The invention further comprises irradiating the cylinder bore surface with a laser beam 22 at a sufficient energy level and for a sufficient time to produce an alloyed layer on the surface of the cylinder bore having enhanced wear characteristics, as shown in Block 12 of FIG. 1. In a preferred embodiment, the entire surface of the cylinder is irradiated.

Figure 3:
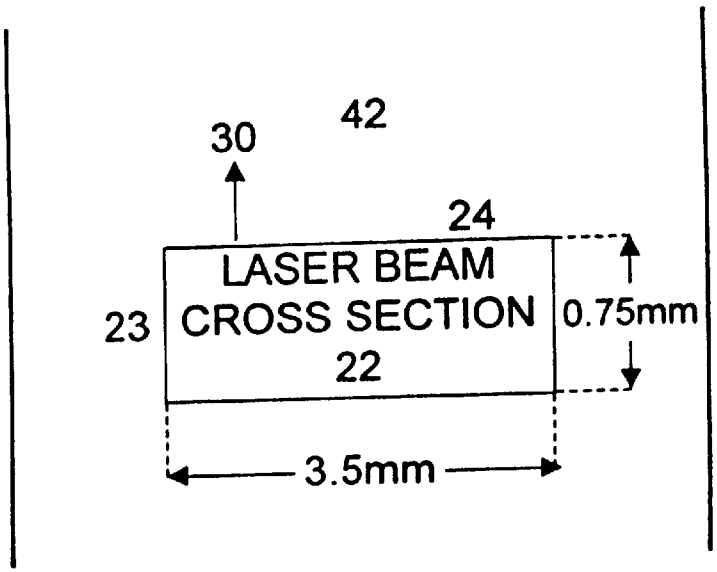
FIG. 3 is an enlarged front view of the laser beam cross sectional area on the surface of the cylinder bore when practicing the method of the present invention.
Figure 5:
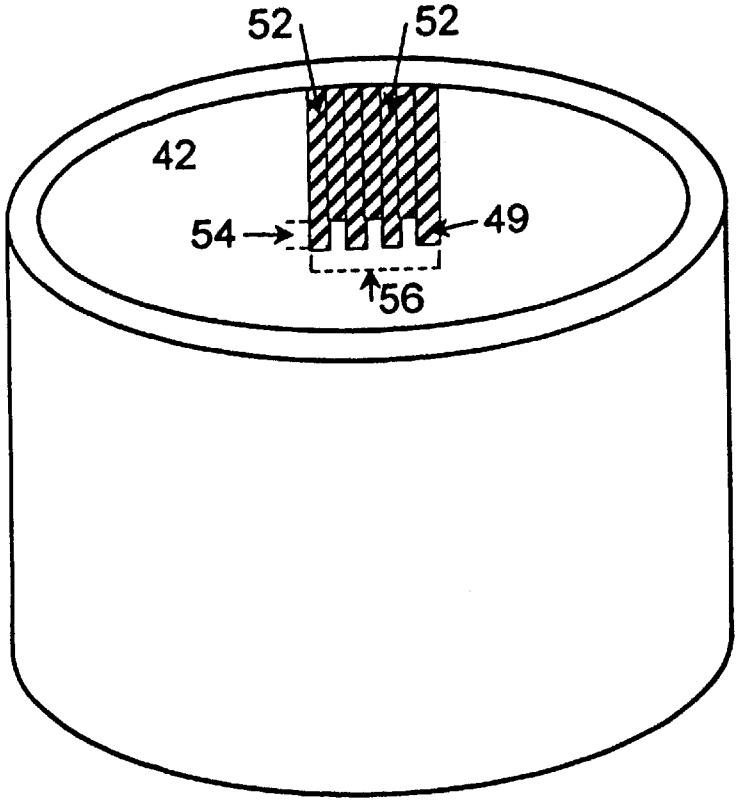
FIG. 5 is an interior view of the cylinder bore during the irradiating step of the present invention.

During the irradiation of the cylinder bore, the cylinder bore and the laser beam are moved relative to each other along a translation axis 30, as shown in FIG. 3. Irradiation is performed in a series of parallel tracks 52 on the surface of the cylinder bore, as shown in FIG. 5. In a preferred embodiment, the irradiation which forms each track begins in the bore at the lower end of the track and moves upward to the cylinder bore rim. In a preferred embodiment, each track has a length differential 54 from its adjacent track, as shown in FIG. 5. As a result of this length differential, a toothlike pattern 56 is formed by the lower ends of adjacent tracks.

In a preferred embodiment, the cylinder surface and the laser beam are moved relative to each other at a translation rate in the range of 4000–9000millimeters per minute and the irradiation is performed at a laser power density in the range of 50 to 150 kilowatts/cm$^2$. In another preferred embodiment the translation rate is 4500 millimeters/minute.

Figure 4:
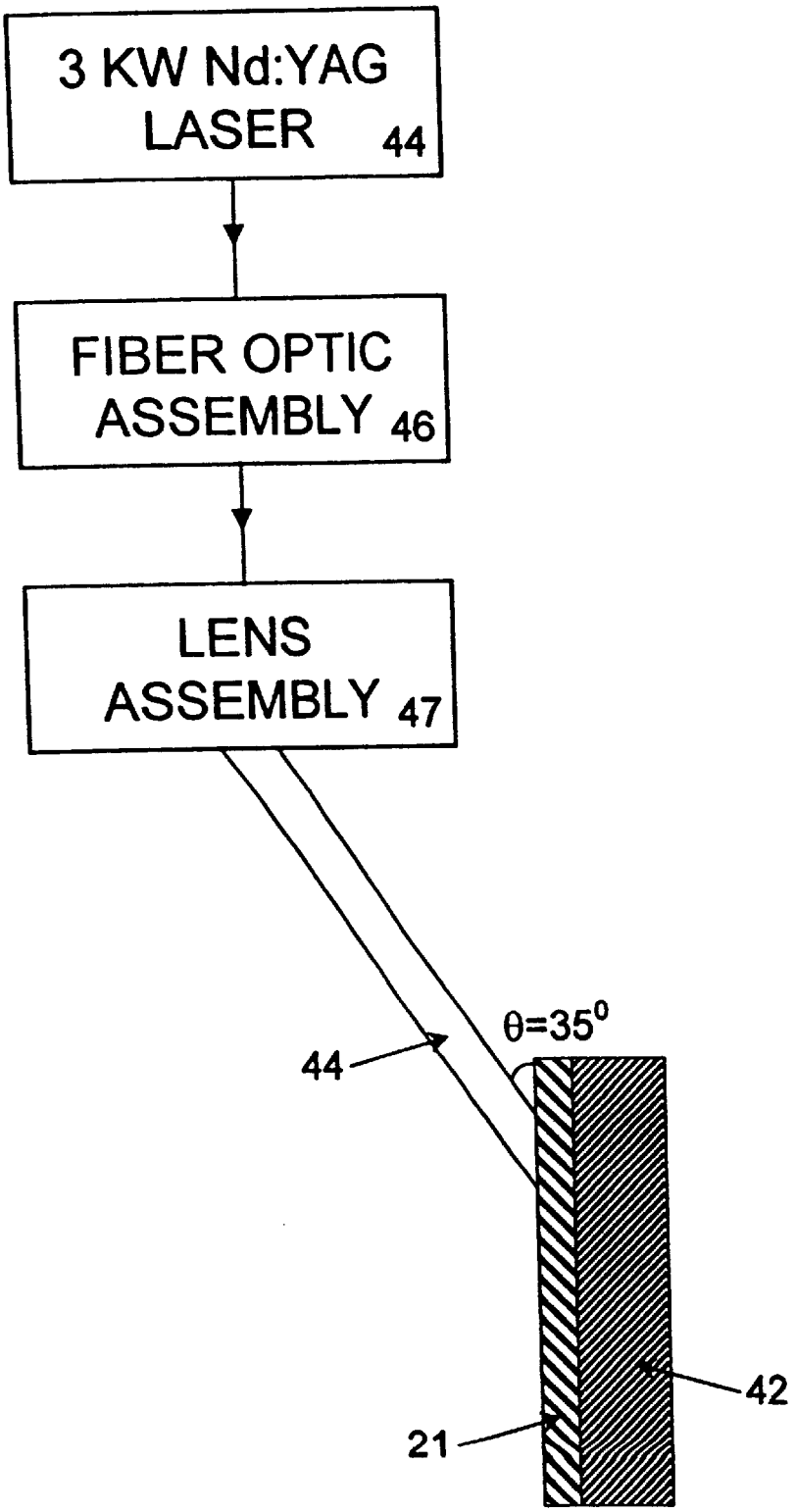
FIG. 4 is a side view of a first laser beam delivery system suitable for use in practicing the present invention.

In a preferred embodiment, the irradiation is performed with a 3 kilowatt Nd:YAG laser 44 passed through a fiber optic delivery system 46 to a lens assembly 47, which focuses the beam onto the cylinder bore surface. As shown in FIG. 4, the laser beam is directed to the surface of the cylinder bore at an acute angle. As also shown in FIG. 4, in a preferred embodiment, the laser beam is directed to the surface of the cylindrical bore in a straight trajectory. In a preferred embodiment, the laser beam is directed at a 35 degree angle to the surface of the cylinder bore, as shown in FIG. 4.

In a preferred embodiment, the present invention further comprises directing a shielding gas 26 at the region of the surface being irradiated by the beam, as shown in Block 14 of FIG. 1. In a preferred embodiment, the shielding gas is nitrogen or argon.

In a preferred embodiment, the laser beam has a rectangular cross sectional area 22, as shown in FIG. 3. This rectangular cross sectional area comprises two shorter sides 23 and two longer sides 24 as shown in FIG. 3. In a preferred embodiment, the longer sides of the rectangular cross sectional area of the laser beam are perpendicular to the translation axis 30 of the beam relative to the piston, as shown in FIG. 3.

In another preferred embodiment, the longer sides of the rectangular cross sectional area have a length of at least 3.5 millimeters and the shorter sides of the rectangular cross sectional area have a length of at least 0.75 millimeters. A rectangular beam profile having the dimensions described above can be achieved by aligning a spherical lens closest to the beam, a second cylindrical lens closest to the substrate and a first cylindrical lens between the spherical lens and the second cylindrical lens. The spherical lens should have a focal length of 101.6 millimeters the first cylindrical lens should have a focal length of 203.2 millimeters. The second cylindrical lens should have a focal length of 152.4 millimeters. The spherical lens and the first cylindrical lens should be spaced apart by five millimeters. The first cylindrical lens and second cylindrical lens should be spaced apart 25 millimeters.

In a preferred embodiment where the cylinder bore is made from wrought aluminum, the laser beam used for irradiating has a power density of 125 kilowatts/cm$^2$. In another embodiment where the cylinder bore is made from cast aluminum, the laser beam used for irradiating has a power density of 75 kilowatts/cm$^2$.

The foregoing disclosure and description of the invention are illustrative and explanatory. Various changes in the size, shape, and materials, as well as in the details of the illustrative embodiments may be made without departing from the spirit of the invention.

What is claimed is:

1. A method for enhancing-the wear resistance of an aluminum cylinder bore comprising:

a. A coating, the interior surface of the cylinder bore with a precursor comprising alloying elements that will result in enhanced wear characteristics when alloyed with the surface of the cylinder bore; and b. irradiating the surface of the cylinder bore with a laser beam having a rectangular cross sectional area at a sufficient energy level and for a sufficient time to produce an alloyed layer on the surface of the cylinder bore having enhanced wear characteristics, said irradiating occurring while the cylinder bore and the laser beam are moved relative to each other.

2. The method of claim 1 further comprising directing a shielding gas at the region of the surface being irradiated.

3. The method of claim 1 wherein said irradiating is performed with a fiber optic laser beam delivery system.

4. The method of claim 1 wherein said irradiating is performed with a Nd:YAG laser.

5. The method of claim 1 wherein said coating is performed by spraying.

6. The method of claim 1 wherein said alloying elements are selected from the group consisting of iron, tin, copper, zirconium, titanium, zirconium-carbide, titanium-carbide, titanium-diboride, molybdenum, molybdenum-disilicide, molybdenum-disulfide, tungsten-carbide, nickel, aluminum, silicon, or silicon-carbide.

7. The method of claim 1 further comprising machining the interior surface of a cylinder bore, prior to said coating, such that the machine surface has a root mean square roughness of less than one micron.

8. The method of claim 1 wherein the cylinder bore is made from cast aluminum and the irradiating takes place at a power density of less than or equal to 75 kilowatts/cm$^2$.

9. The method of claim 1 wherein the cylinder bore is made from wrought aluminum and the irradiating takes place at a power density of less than or equal to 125 kilowatts/cm$^2$.

10. A method for enhancing the wear resistance of an aluminum cylinder bore comprising:

a. machining the interior surface the bore such that it has a root mean square roughness of less than one micron;

b. coating the interior surface of the cylinder bore with a precursor comprising alloying elements that will result in enhanced wear characteristics when alloyed with the surface of the cylinder bore; and c. irradiating the surface of the cylinder bore with a laser beam having a rectangular cross sectional area at a sufficient energy level and for a sufficient time to produce an alloyed layer on the surface of the cylinder bore having enhanced wear characteristics, said irradiating occurring while the cylinder bore and the laser beam are moved relative to each other.

11. The method of claim 10 wherein said machining is performed with a cylindrical surfacing machine.

12. The method of claim 10 further comprising honing the surface of the cylinder bore.

13. The method of claim 10 wherein said irradiating is performed in a series of parallel tracks on the surface of the cylinder bore, each of said tracks comprising a lower end.

14. The method of claim 13 wherein said irradiating which forms each of said tracks begins in the bore at the lower end of each track and moves upward to the cylinder bore rim.

15. The method of claim 10 wherein said coating is performed by spraying.

16. The method of claim 10 wherein said alloying elements are selected from the group consisting of iron, tin, copper, zirconium, titanium, zirconium-carbide, titanium-carbide, titanium-diboride, molybdenum, molybdenum-disilicide, molybdenum-disulfide, tungsten-carbide, nickel, aluminum, silicon, or silicon-carbide.

17. A method for enhancing the wear resistance of an aluminum cylinder bore comprising:

a. machining the interior surface the bore such that it has a root mean square roughness of less than one micron;

b. coating the interior surface of the cylinder bore with a precursor comprising alloying elements that will result in enhanced wear characteristics when alloyed with the surface of the cylinder bore;

c. irradiating the surface of the cylinder bore with a laser beam having a rectangular cross sectional area at a sufficient energy level and for a sufficient time to produce an alloyed layer on the surface of the cylinder bore having enhanced wear characteristics, said irradiating occurring while the cylinder bore and the laser beam are moved relative to each other; and d. after said irradiating, honing the surface of the cylinder bore.

18. The method of claim 17 wherein said alloying elements are selected from the group consisting of iron, tin, copper, zirconium, titanium, zirconium-carbide, titanium-carbide, titanium-diboride, molybdenum, molybdenum-disilicide, molybdenum-disulfide, tungsten-carbide, nickel, aluminum, silicon, or silicon-carbide.

* * * * *

UNITED STATES PATENT AND TRADEMARK OFFICE

CERTIFICATE OF CORRECTION

PATENT NO. : 6,299,707 B1
DATED : October 9, 2001
INVENTOR(S) : McCay et al.

It is certified that error appears in the above-identified patent and that said Letters Patent is hereby corrected as shown below:

Column 3,
Line 22, delete "A coating", and insert -- coating --.

Signed and Sealed this

Twelfth Day of March, 2002

*Attest:*

*Attesting Officer*

JAMES E. ROGAN
*Director of the United States Patent and Trademark Office*